United States Patent [19]

Baker, III et al.

[11] 4,302,525

[45] Nov. 24, 1981

[54] NOVEL PHOTOSENSITIVE ELEMENTS AND METHOD OF STABILIZING SAID ELEMENTS

[75] Inventors: T. Nelson Baker, III, Sudbury; Bernard Zuckerman, Framingham, both of Mass.

[73] Assignee: Polaroid Corporation, Cambridge, Mass.

[21] Appl. No.: 121,799

[22] Filed: Feb. 15, 1980

Related U.S. Application Data

[63] Continuation-in-part of Ser. No. 918,841, Jun. 26, 1978.

[51] Int. Cl.[3] ..... G03C 1/02; G03C 5/00

[52] U.S. Cl. ..... 430/217; 430/219; 430/230; 430/569; 430/570; 430/613; 430/615; 430/614

[58] Field of Search ..... 430/217, 219, 230, 227, 430/613, 615, 569, 570, 614

[56] References Cited

U.S. PATENT DOCUMENTS

| | | | |
|---|---|---|---|
| 2,449,225 | 9/1948 | Heimbach et al. | 430/615 |
| 2,713,541 | 7/1955 | Allen et al. | 430/613 |
| 2,716,062 | 8/1955 | Carroll et al. | 430/615 |
| 2,743,180 | 4/1956 | Carroll | 430/615 |
| 2,756,147 | 7/1956 | Reynolds et al. | 430/615 |
| 2,835,581 | 5/1958 | Tinker et al. | 430/615 |
| 2,933,388 | 4/1960 | Knott | 430/614 |
| 2,944,902 | 7/1960 | Carroll et al. | 430/615 |
| 3,161,506 | 12/1964 | Becker et al. | 430/219 |
| 3,331,840 | 7/1967 | Fry et al. | 430/614 |
| 3,333,961 | 8/1967 | Fry et al. | 430/615 |
| 3,418,130 | 12/1968 | Stevens et al. | 430/615 |
| 3,705,034 | 12/1972 | McNamara | 430/569 |
| 4,011,083 | 3/1977 | Durning et al. | 430/615 |

*Primary Examiner*—J. Travis Brown
*Attorney, Agent, or Firm*—Philip G. Kiely

[57] ABSTRACT

Photosensitive silver halide emulsions for use in diffusion transfer processes are stabilized without adversely affecting spectral sensitization by the following steps: (a) spectrally sensitizing the silver halide grains; (b) lowering the pH of the emulsion from a first pH of the emulsion subsequent to chemical ripening to a pH of about 5.5 to 4.0 and/or increasing the Br ion/Ag ratio to at least 5 mg Br ion/gAg and, subsequent to steps (a) and (b), (c) adding 5–80 mg/gAg to said emulsion of a stabilizer selected from the group consisting of an hydroxy triazaindene, an amino triazaindene, an hydroxy tetrazaindene, an amino tetrazaindene, an hydroxy pentazaindene and an amino pentazaindene.

34 Claims, No Drawings

NOVEL PHOTOSENSITIVE ELEMENTS AND METHOD OF STABILIZING SAID ELEMENTS

CROSS REFERENCE TO OTHER APPLICATIONS

This application is a continuation-in-part of copending application Ser. No. 918,841, filed June 26, 1978.

BACKGROUND OF THE INVENTION

It is known in the art one can stabilize silver halide emulsions with respect to shelf stability with an azaindene as illustrated, for example, in U.S. Pat. Nos. 2,444,607; 2,444,609; 2,449,225 and 2,460,397. In these listed patents, the efficacy of various azaindenes is illustrated when they are incorporated as solutions at pH 7–10 into silver halide emulsions. The patents are silent with respect to spectral sensitization of the silver halide grains.

U.S. Pat. No. 2,743,180 is directed to the treatment of unsensitized and optically sensitized silver halide emulsions with polyalkylene oxides and pentazaindenes to stabilize emulsions upon storage.

U.S. Pat. Nos. 2,772,164; 2,835,581 and 3,333,961 are directed to chemically or optically sensitized silver halide emulsions containing, as antifoggants, specified classes of triazaindens, tetrazaindenes and pentazaindens.

U.S. Pat. Nos. 3,418,130; 3,462,272 and 3,563,755 are directed to silver halide emulsions containing, as antifoggants, specified classes of tetrazaindenes. It is stated that these compounds do not result in the reduction of sensitivity when used. The only teaching relevant to their use is that they are added after digestion.

U.S. Pat. No. 3,161,506 is directed to color diffusion transfer processes and elements which include an optically sensitized silver halide emulsion having a dye developer associated therewith wherein the emulsion contains a member of the class consisting of hydroxy and amino triazaindenes, hydroxy and amino tetrazaindenes and hydroxy and amino pentazaindenes. The patent merely states that the emulsions contain the specified compounds; it is silent with respect to the manner of incorporating the compounds therein.

SUMMARY OF THE INVENTION

The present invention is directed to the stabilization of photosensitive silver halide emulsions against the build up of fog centers during storage. The described triazaindenes, tetrazaindenes and pentazaindenes are known in the art to function as such stabilizers. However, it has been found that the use of such stabilizers at levels of about 5 mg/gAg and greater results in speed loss believed to be the result of displacement of at least some of the spectral sensitizing dye or dyes from the surface of the silver halide crystal.

Photosensitive silver halide emulsions, particularly silver halide emulsions useful in diffusion transfer processes, are stabilized against the building up of fog centers during storage without adversely affecting spectral sensitization by the following steps:

(a) spectrally sensitizing silver halide grains with one or more spectral sensitizing dyes;

(b) lowering the pH of the emulsion from a first pH subsequent to chemical ripening to a second pH of about 5.5 to 4.0, and/or increasing the Br ion/Ag ratio to at least 5 mg Br ion/gAg; and, subsequent to steps (a) and (b), (c) adding 5 to 80 mg/gAg of a stabilizer selected from the group consisting of an hydroxy triazaindene, an amino triazaindene, an hydroxy tetrazaindene, an amino tetrazaindene, an hydroxy pentazaindene and an amino pentazaindene.

DETAILED DESCRIPTION OF THE INVENTION

It has now been found that effective amounts of the described stabilizers can be employed without significant speed loss or otherwise deleteriously affecting the photographic properties of the silver halide emulsions. These advantages are achieved by carrying out the following steps on a silver halide emulsion prepared by conventional methods known in the art:

(a) spectrally sensitizing the silver halide grains of said emulsion by contacting said grains with one or more spectral sensitizing dyes;

(b) adjusting the pH of the emulsion from the pH subsequent to chemical ripening of about 5.5 to 4.0 by, for example, addition of a suitable acid such as sulfuric acid; and/or increasing the Br ion/Ag ratio to at least 5 mg Br ion/gAg; and, subsequent to steps (a) and (b), (c) adding 5 to 80 mgs/gAg of a stabilizer selected from the group consisting of an hydroxy triazaindene, an amino triazaindene, an hydroxy tetrazaindene, an amino tetrazaindene, an hydroxy pentazaindene and an amino pentazaindene.

The adjustment of the Br ion/Ag ratio is accomplished by techniques known to the art; e.g. by the addition of a water-soluble bromide salt such as potassium bromide. This bromide ion adjustment is made to the emulsion prior to coating and cannot be carried out during or subsequent to coating.

The specific pH change to the second pH will be determined especially since it is a function of the materials employed in the emulsion, particularly the specific stabilizer selected. The second pH is not critical so long as it falls between the specified limits. The first pH referred to herein is the pH of the emulsion subsequent to chemical ripening and is in excess of about 6.0 and generally between 6.0 and 6.5.

Subsequent to the above-indicated stabilization of the emulsion, it is coated on a suitable support and incorporated into film units in a conventional manner. The emulsions prepared according to the present invention are useful in all types of film units, particularly color diffusion transfer film units and silver diffusion transfer film units.

It will be seen that the novel method of the present invention can be carried out with step (b) consisting of either a pH change, the Br ion/Ag ratio change or a combination of both pH and Br ion change. While the sequence of steps (a) and (b) is not critical, it is critical that addition of the stabilizer follows steps (a) and (b).

The specific combination of steps defined by the present invention will be selected with regard to optimization of the sensitometry as determined by the specific photographic process employed, dye transfer or silver transfer.

The term "silver halide" as used herein is intended to refer to silver iodide, silver bromide, silver iodobromide, silver iodochloride, silver chlorobromide, and silver iodochlorobromide wherein said chloride is present at a level of not more than about 10 mole percent.

EXAMPLE A (Control)

A photosensitive element was prepared by coating, in succession, on a gelatin subbed, opaque polyethylene terephthalate film base, the following layers:

1. a layer comprising the cyan dye developer

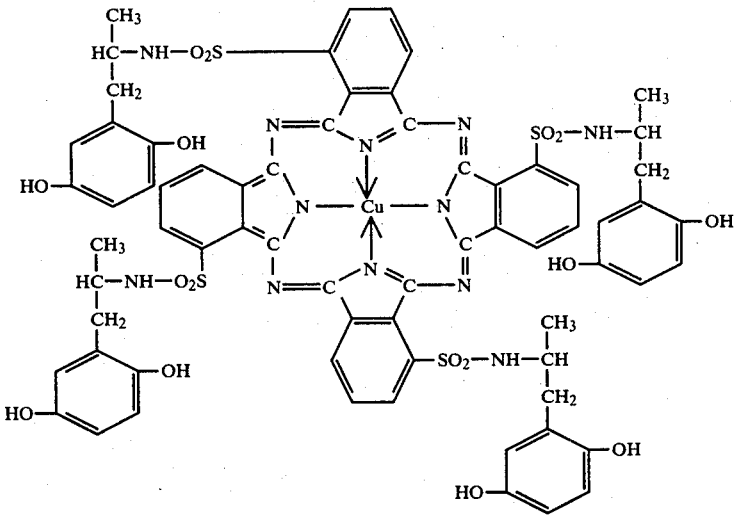

dispersed in gelatin and coated at a coverage of about 50 mg/ft$^2$ of dye, about 100 mg/ft$^2$ of gelatin, and about 5 mg/ft$^2$ of 4'-methylphenyl-hydroquinone;

2. a red-sensitive gelatino silver iodobromide emulsion layer having about 1.05$\mu$ average diameter grains coated at a coverage of about 80 mg/ft$^2$ of silver and about 104 mg/ft$^2$ of gelatin containing 1 mg/gAg of 4-hydroxy-6-methyl-1,3,3a,7-tetrazaindene, 2 mg/gAg of Br ion and a pH of 6.3 wherein the tetrazaindene was added before the spectral sensitizer and the Br ion addition, to adjust pAg, followed sensitization;

3. an interlayer coated at a coverage of about 594 mg/ft$^2$ of a 60-30-4-6 tetrapolymer of butylacrylate, diacetone acrylamide, styrene and methacrylic acid, about 30 mg/ft$^2$ of polyacrylamide permeator, and about 4 mg/ft$^2$ of succindialdehyde as a hardener;

4. a layer comprising the magenta dye developer

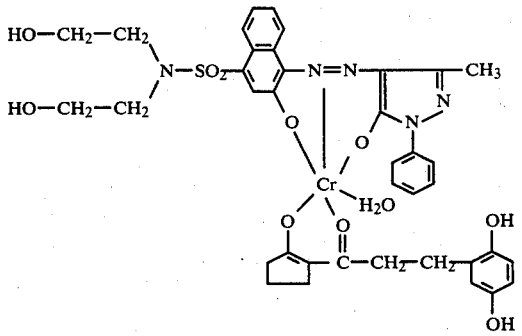

dispersed in gelatin and coated at a coverage of about 60 mg/ft$^2$ of dye, about 42 mg/ft$^2$ of gelatin.

5. a gelatino silver iodobromide emulsion layer having about 1.2$\mu$ average diameter grains, sensitized to green with spectral sensitizing dyes, at a coverage of 30 mg/ft$^2$ of silver and about 43 mg/ft$^2$ of gelatin and a second gelatino silver iodobromide emulsion layer having about 0.7$\mu$ average diameter grains coated at a coverage of about 30 mg/ft$^2$ of silver sensitized to green with spectral sensitizing dyes and about 36 mg/ft$^2$ of gelatin and the same quantity and order of addition of 4-hydroxy-6-methyl-1,3,3a,7-tetrazaindene, Br ion and pH as layer 2;

6. an interlayer containing the tetrapolymer referred to above in layer 3 at a coverage of about 250 mg/ft$^2$, about 20 mg/ft$^2$ of polyacrylamide, and about 3 mg/ft$^2$ of succindialdehyde as a hardener;

7. a layer comprising the yellow dye developer

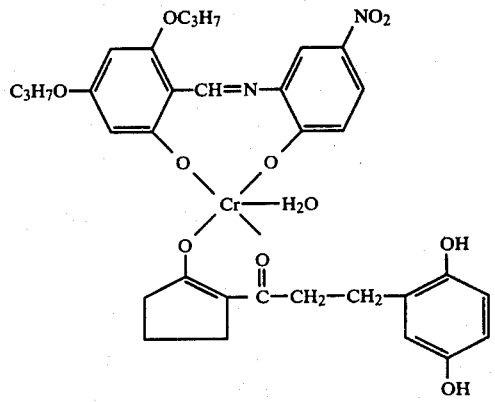

dispersed in gelatin and coated at a coverage of about 67 mg/ft$^2$ of dye and about 32 mg/ft$^2$ of gelatin;

8. a gelatino silver iodobromide emulsion layer having about 1.05$\mu$ average diameter grains, sensitized to blue with spectral sensitizing dyes, coated at a coverage of about 119 mg/ft$^2$ of silver, about 52 mg/ft$^2$ of gelatin, and the same quantity and order of addition of 4-hydroxy-6-methyl-1,3,3a,7-tetrazaindene, Br ion and pH as layers 2 and 5;

9. an overcoat layer coated at a coverage of about 40 mg/ft$^2$ of gelatin and 4 mg/ft$^2$ of carbon.

An image-receiving element comprising the following layers in succession on a 4 mil polyethylene terephthalate film base, said layers respectively comprising:

1. as a polymeric acid layer, the partial butyl ester of polyethylene/maleic anhydride copolymer at a coverage of about 2,500 mg/ft$^2$;

2. a timing layer containing about a 75:1 ratio of a 60-30-4-6 copolymer of butylacrylate, diacetone acrylamide, styrene and methacrylic acid and polyvinyl alcohol at a coverage of about 500 mg/ft$^2$; and 3. a polymeric image-receiving layer containing a 2:1 mixture, by weight, of polyvinyl alcohol and poly-4-vinylpyridine, at a coverage of about 300 mg/ft$^2$.

The following processing composition was employed

| | Weight % |
|---|---|
| Potassium hydroxide | 5.25 |
| N-phenethyl-α-picolinium bromide (50% solution in water) | 1.27 |
| Sodium carboxymethyl hydroxethyl cellulose (Hercules Type 420H) | 2.0 |
| Titanium dioxide | 37.4 |
| 6-methyl uracil | 0.7 |
| bis-(β-aminoethyl)-sulfide | 0.02 |
| Benzotriazole | 5.48 |
| Colloidal silica aqueous dispersion (30% $SiO_2$) | 0.55 |
| N-2-hydroxyethyl-N,N',N'-tris-carboxymethyl-ethylene diamine | 0.75 |
| 4-amino pyrazolo-[3,4d]-pyrimidine | 0.25 |
| 6-benzylamino-purine | 0.41 |
| Polyethylene glycol (molecular weight 4,000) | 0.45 |
| Water | 44.26 |

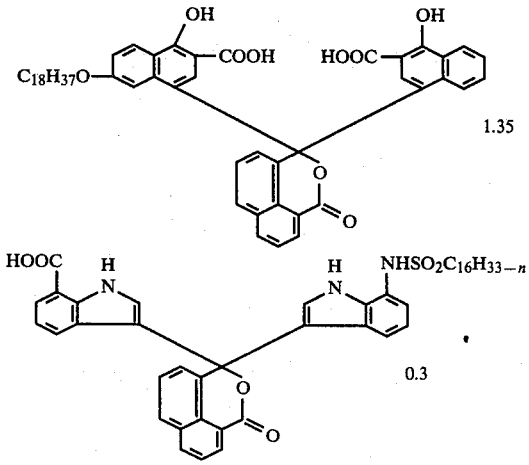

EXAMPLE 1

A second photosensitive element was prepared as described above with the following changes: layer 2 contained 100 mg/ft$^2$ of silver, 130 mg/ft$^2$ of gelatin, and as a stabilizing system, the pH was adjusted to 5.1; the Br ion to 2 mg/gAg followed by the addition of 19 mg/gAg of 4-hydroxy-6-methyl-1,3,3a,7-tetrazaindene; layer 8 contained 137 mg/ft$^2$ of silver, 60 mg/ft$^2$ of gelatin, and, as a stabilizing system, the emulsion contained 20 mg/gAg of 4-hydroxy-6-methyl-1,3,3a,7-tetrazaindene, (1) 11 mg/gAg of Br ion and (2) a pH of 5.3 carried out in the following order, (1) pH adjustment; (2) Br ion addition and (3) tetrazaindene addition. A different red-sensitizing dye was employed in layer 2 from Example A but as will be seen below, this does not effect the validity of this comparison.

The photosensitive elements were exposed to a multicolor target and the processing composition was spread in the dark between the photosensitive element and the image-receiving element in a layer approximately 0.0028" thick. After the image cleared, about 5 min., the resulting positive images were then read to red, green and blue light in a recording densitometer without separation from the negative.

Table 1 shows the sensitometric data obtained on the film unit of Example A processed at room temperature (75° F.) after storage for various periods of time.

Tables 2 and 3 show data obtained in film units prepared according to the procedure of Example A stored at room temperature and processed in the "hot" (95° F.) and "cold" (50° F.). The $D_{max}$ and speed are reported as the difference between the room temperature processing values and the hot and cold temperature processing values.

TABLE 1

| Shelf Storage Time | $D_{Max}$ | | | Speed | | | Bal | |
|---|---|---|---|---|---|---|---|---|
| (Mo) | Red | Green | Blue | Red | Green | Blue | Red | Blue |
| Initial | 1.83 | 2.17 | 2.06 | 1.63 | 1.59 | 1.54 | +.04 | −.05 |
| 1 | 1.90 | 2.24 | 2.07 | 1.61 | 1.57 | 1.55 | +.04 | −.02 |
| 2 | 1.85 | 2.18 | 2.04 | 1.62 | 1.57 | 1.58 | +.05 | +.01 |
| 3 | 1.85 | 2.23 | 2.03 | 1.56 | 1.51 | 1.53 | +.05 | +.02 |
| 4 | 1.90 | 2.23 | 2.01 | 1.56 | 1.51 | 1.53 | +.05 | +.02 |
| 5 | 1.86 | 2.18 | 1.97 | 1.57 | 1.52 | 1.55 | +.05 | +.03 |
| 7 | 1.84 | 2.18 | 1.95 | 1.58 | 1.49 | 1.54 | +.09 | +.05 |
| 8 | 1.83 | 2.16 | 1.91 | 1.56 | 1.50 | 1.55 | +.06 | +.05 |
| 9 | 1.84 | 2.15 | 1.89 | 1.59 | 1.54 | 1.59 | +.05 | +.05 |
| 11 | 1.74 | 2.04 | 1.81 | 1.61 | 1.54 | 1.59 | +.07 | +.05 |
| 12 | 1.82 | 2.14 | 1.85 | 1.56 | 1.47 | 1.55 | +.09 | +.08 |

TABLE 2

95° F. Processing

| Shelf Storage Time | Δ $D_{Max}$ | | | Δ Speed | | | Δ Bal | |
|---|---|---|---|---|---|---|---|---|
| (Mo) | Red | Green | Blue | Red | Green | Blue | Red | Blue |
| Initial | −.66 | −.35 | −.29 | +.05 | .00 | −.02 | +.05 | −.02 |
| 1 | −.75 | −.44 | −.31 | +.08 | +.03 | +.02 | +.05 | −.01 |
| 2 | −.74 | −.41 | −.35 | +.10 | +.07 | +.07 | +.03 | .00 |
| 3 | −.81 | −.45 | −.35 | +.18 | +.12 | +.10 | +.06 | −.02 |
| 4 | −.93 | −.48 | −.44 | +.18 | +.13 | +.10 | +.05 | −.03 |
| 5 | −.92 | −.41 | −.39 | +.19 | +.11 | +.09 | +.08 | −.02 |
| 7 | −.88 | −.41 | −.37 | +.19 | +.12 | +.09 | +.07 | −.03 |
| 8 | −.97 | −.67 | −.46 | +.25 | +.14 | +.12 | +.11 | −.02 |
| 9 | −.92 | −.63 | −.40 | +.24 | +.16 | +.11 | +.08 | −.05 |
| 11 | −.87 | −.58 | −.42 | +.24 | +.15 | +.13 | +.09 | −.02 |
| 12 | −.96 | −.72 | −.48 | +.31 | +.19 | +.17 | +.12 | −.02 |

TABLE 3

50° F. Processing

| Shelf Storage Time | Δ $D_{Max}$ | | | Δ Speed | | | Δ Bal | |
|---|---|---|---|---|---|---|---|---|
| (Mo) | Red | Green | Blue | Red | Green | Blue | Red | Blue |
| Initial | +.16 | .00 | −.02 | −.18 | −.14 | −.08 | −.04 | +.06 |
| 1 | +.15 | −.01 | .00 | −.18 | −.12 | −.05 | −.06 | +.07 |
| 2 | +.20 | +.07 | +.02 | −.21 | −.14 | −.08 | −.07 | +.06 |
| 3 | +.18 | −.01 | +.01 | −.11 | −.04 | −.01 | −.07 | +.03 |
| 4 | +.13 | −.03 | −.01 | −.06 | .00 | +.02 | −.06 | +.02 |
| 5 | +.15 | −.02 | −.01 | −.13 | −.06 | −.03 | −.07 | +.03 |
| 7 | +.20 | −.02 | −.05 | −.24 | −.13 | −.10 | −.11 | +.03 |
| 8 | +.12 | −.05 | −.05 | −.28 | −.17 | −.13 | −.11 | +.04 |
| 9 | +.09 | −.07 | −.06 | −.25 | −.16 | −.14 | −.09 | +.02 |
| 11 | +.21 | +.06 | +.01 | −.36 | −.23 | −.21 | −.13 | +.02 |
| 12 | +.09 | −.12 | −.16 | −.28 | −.14 | −.15 | −.14 | −.01 |

It will be noted that upon room temperature storage the most drastic changes are a substantial loss of blue $D_{max}$ and a red and blue balance shift. The storage instability is indicated by the increasing $\Delta D_{max}$ loss in hot processing and increasing speed loss in cold processing. Blue balance shift is indicated above on room temperature storage and processing but is not noted on hot processing.

The term "Balance", as employed herein, refers to the difference in blue and red speed relative to the green speed at the temperature at which the film was processed.

Tables 4, 5, and 6 contain similar data derived from the film unit of Example 1.

TABLE 4

| Shelf Storage Total | $D_{Max}$ | | | Speed | | | Bal | |
|---|---|---|---|---|---|---|---|---|
| (Months) | Red | Green | Blue | Red | Green | Blue | Red | Blue |
| Initial | 1.90 | 2.08 | 2.15 | 1.58 | 1.62 | 1.53 | −.04 | −.09 |
| 3 | 1.96 | 2.06 | 2.12 | 1.52 | 1.60 | 1.55 | −.08 | −.05 |
| 6 | 1.90 | 2.08 | 2.11 | 1.55 | 1.60 | 1.57 | −.05 | −.03 |
| 9 | 1.91 | 2.05 | 2.09 | 1.54 | 1.59 | 1.55 | −.05 | −.04 |
| 12 | 1.95 | 2.08 | 2.07 | 1.51 | 1.56 | 1.56 | −.05 | .00 |

TABLE 5

| | 95° Processing | | | | | | | |
|---|---|---|---|---|---|---|---|---|
| Shelf Storage Time | Δ $D_{Max}$ | | | Δ Speed | | | Δ Bal | |
| (Mo) | Red | Green | Blue | Red | Green | Blue | Red | Blue |
| Initial | −.52 | −.34 | −.28 | +.13 | +.11 | +.06 | +.02 | −.05 |
| 3 | −.50 | −.37 | −.35 | +.17 | +.16 | +.12 | +.01 | −.04 |
| 6 | −.33 | −.24 | −.21 | +.08 | +.07 | +.05 | +.01 | −.02 |
| 9 | −.43 | −.29 | −.27 | +.12 | +.11 | +.08 | +.01 | −.03 |
| 12 | −.44 | −.34 | −.28 | +.14 | +.14 | +.10 | .00 | −.06 |

TABLE 6

| | 50° F. Processing | | | | | | | |
|---|---|---|---|---|---|---|---|---|
| Shelf Storage Time | Δ $D_{Max}$ | | | Δ Speed | | | Δ Bal | |
| (Mo) | Red | Green | Blue | Red | Green | Blue | Red | Blue |
| Initial | −.06 | −.22 | +.09 | −.35 | −.27 | −.16 | −.08 | +.11 |
| 3 | −.13 | −.24 | +.08 | −.31 | −.23 | −.17 | −.08 | +.06 |
| 6 | −.12 | −.27 | +.06 | −.27 | −.20 | −.15 | −.07 | +.05 |
| 9 | −.09 | −.18 | +.08 | −.28 | −.21 | −.15 | −.07 | +.06 |
| 12 | −.21 | −.33 | +.09 | −.24 | −.13 | −.09 | −.11 | +.04 |

An overall improvement in shelf life stability is obtained with particular improvement in 95° F. performance of shelf stored film units. Also, an improvement in speed at 50° F. processing was noted with time.

A film unit (Example 2) was prepared as described in Example A, except that it was stabilized according to the procedure of the present invention. The order of stabilization was the same as that employed in Example 1. Table 7 shows the stabilizing system of Example A compared to Example 2. The only difference in the two film units was in the stabilizing system detailed below.

TABLE 7

| | 4-hydroxy-6-methyl-1,3,3a,7-tetrazaindene | Br ion mg/gAg | pH |
|---|---|---|---|
| Layer 2 | | | |
| Example A (Control) | 1 | 2 | 6.3 |
| Example 2 (Invention) | 20 | 2 | 5.1 |
| Layer 5 | | | |
| Example A | 1 | 2 | 6.45 |
| Example 2 | 1 | 2 | 5.1 |
| Layer 8 | | | |
| Example A | 1 | 2 | 6.1 |
| Example 2 | 20 | 11 | 5.1 |

The film units were exposed and processed as above and the effect of the stabilization is set forth below.

TABLE 8

| | Room Temperature Processing | | | | | | | | 95° Processing | | |
|---|---|---|---|---|---|---|---|---|---|---|---|
| Room Temp. | $D_{Max}$ | | | Speed | | | Bal | | $D_{Max}$ | | |
| Storage | Red | Green | Blue | Red | Green | Blue | Red | Blue | Red | Green | Blue |
| Example B | | | | | | | | | | | |
| 24 Hrs. | 2.09 | 2.22 | 2.03 | 1.47 | 1.57 | 1.61 | −.10 | +0.4 | 1.68 | 1.90 | 1.71 |
| 6 Mos. | 2.03 | 2.12 | 1.87 | 1.49 | 1.59 | 1.65 | 0 | +2 | 1.38 | 1.55<br>1.39 | |
| Example 2 | | | | | | | | | | | |
| 24 Hrs. | 2.10 | 2.24 | 2.16 | 1.37 | 1.51 | 1.52 | −.14 | +.01 | 1.72 | 1.99 | 1.91 |
| 6 Mos. | 2.10 | 2.18 | 2.04 | 1.37 | 1.48 | 1.52 | +.03 | +.03 | 1.78 | 1.82 | 1.69 |

Table 9 shows the accelerated aging performance of Examples B and 2. The values shown are $\Delta D_{max}$ values compared to the 24 hours, room temperature processing sample.

TABLE 9

| | 6 Day, 120° F. Aging 75° F. Processing $\Delta D_{max}$ | | | 6 Day, 120° Aging 95° F. Processing $\Delta D_{Max}$ | | |
|---|---|---|---|---|---|---|
| | Red | Green | Blue | Red | Green | Blue |
| Example B | −.13 | −.21 | −.30 | −.96 | −.87 | −.84 |
| Example 2 | −.01 | −.03 | −.11 | −.45 | −.41 | −.45 |

From the above it will be seen that the accelerated aging shows that an improvement in shelf aging would be obtained in the film unit stabilized by the present invention when processed at 75° F. and that a significant improvement would be obtained with 95° F. processing. The actual room temperature storage data set forth above confirms the accelerated aging predictions, particularly with respect to minimization of increasing $D_{max}$ loss at 95° F. processing as a function of aging.

The method for stabilizing silver halide emulsions of the present invention is not limited to color diffusion transfer systems. Thus, any silver halide emulsion wherein the grains are spectrally sensitized can utilize the present invention to obtain enhanced stability without interference with spectral sensitization. The following example illustrates a negative stabilized according to the procedure of the present invention and employed with a receiving layer containing silver precipitating nuclei and which is adapted to receive a silver diffusion transfer image.

EXAMPLE 3

A silver iodobromide (6% I) emulsion was bulked with deionized gel to a ratio of 3.8/1 gel to silver. Sufficient aqueous potassium bromide was added to achieve a Br ion/Ag ratio of 17.8 mg/g Ag, then the emulsion was spectrally pan sensitized by consecutively adding a combination of three dyes, and stabilized with 4-hydroxy-6-methyl-1,3,3a, 7-tetrazaindene (as the potassium salt) added at 32.7 mg/g Ag. 0.13 mg phenyl mercaptotetrazole/g Ag was added. This emulsion was coated with a gel undercoat (74 mg/ft$^2$) and topcoat (60 mg/ft$^2$). After exposure and processing with a Type 107 C receiving sheet and processing composition (Polaroid Corporation, Cambridge, Mass.), the action spectrum demonstrated high green and red speed relative to inherent blue sensitivity. In addition, the stability of the system in accelerated tests at 10 day/120 F as well as actual shelf life has been demonstrated in terms of minimal $D_{max}$ losses.

Similar advantageous results are achieved employing, as the stabilizer, 7-benzylamino-1,3,4,6-tetrazaindene in a film unit of the type described in Example 1 wherein the Br ion/Ag ratio was raised from 2 to 32 mg/gAg, and the pH was decreased from 9.0 to 6.0 in layer 2.

As will be seen by the above examples, the novel process of the present invention can be employed satisfactorily in both color diffusion transfer processes and silver diffusion transfer processes and silver diffusion transfer processes known to the art, as illustrated, for example, in the following U.S. Pat. Nos.: 2,543,181; 2,983,606; 3,415,644; 3,415,645; 3,415,646; 3,473,925; 3,482,972; 3,551,406; 3,573,042; 3,573,043; 3,573,044; 3,576,625; 3,576,626; 3,578,540; 3,569,333; 3,579,333; 3,594,164; 3,594,165; 3,597,200; 3,647,437; 3,672,486; 3,672,890; 3,705,184; 3,752,836; and 3,857,865 all of which are incorporated here in their entirety.

Essentially, diffusion transfer photographic products and processes involve film units having a photosensitive system including at least one silver halide layer usually integrated with an image-providing material. After photoexposure, the photosensitive system is developed to establish an imagewise distribution of a diffusible image-providing material, at least a portion of which is transferred by diffusion to an image-receiving layer capable of mordanting or otherwise fixing the transferred image-providing material.

What is claimed is:

1. A method for stabilizing a photosensitive silver halide emulsion for use in a photographic duffusion transfer process which comprises the following steps:
   (a) spectrally sensitizing the silver halide grains with at least a first spectral sensitizing dye;
   (b) lowering the pH of the sensitized emulsion from a first pH of the emulsion subsequent to chemical ripening in excess of about 6 to a second pH of about 5.5 to about 4.0 and/or increasing the Br ion/Ag ratio to at least 5 mg Br/gAg; and, subsequent to steps (a) and (b),
   (c) adding to said emulsion about 5 to 80 mg/gAg of a stabilizer selected from the group consisting of an hydroxy triazaindene, an amino triazaindene, an hydroxy tetrazaindene, an amino tetrazaindene, an hydroxy pentazaindene and an amino pentazaindene.

2. The method of claim 1 wherein said step (b) comprises lowering the pH of the sensitized emulsion from a first pH of about 6.0 to 6.5 to a second pH of about 5.0.

3. The method of claim 1 or 2 wherein said step (b) comprises increasing the Br ion/Ag ratio to at least 5 mg Br/gAg.

4. The method of claim 1 wherein said stabilizer is an hydroxy tetrazaindene.

5. The method of claim 4 wherein said stabilizer is 4-hydroxy-6-methyl-1,3,3a, 7-tetrazaindene.

6. The method of claim 1 wherein said stabilizer is 7-benzylamino-1,3,4,6-tetrazaindene.

7. The method of claim 1 wherein said silver halide grains are spectrally sensitized to red, green or blue light.

8. The method of claim 1 wherein said silver halide grains are pan sensitized.

9. A photosensitive element comprising a support carrying at least one stabilized silver halide emulsion layer spectrally sensitized with at least a first spectral sensitizing dye, said emulsion having a pH of about 5.5 to 4.0 and/or a Br ion/Ag ratio of at least 5 mg Br ion/g AG wherein said emulsion layer has been stabilized by:
   (a) lowering the pH of said emulsion from a first pH of the emulsion subsequent to chemical ripening in excess of about 6 to a second pH of about 5.5 to 4.0 and/or increasing the Br ion/Ag ratio to at least 5 mg Br ion/g Ag and subsequent to step (a),
   (b) adding 5–80 mg/gAg to said emulsion of a stabilizer selected from the group consisting of an hydroxy triazaindene, an amino triazaindene, an hydroxy tetrazaindene, an amino tetrazaindene, an hydroxy pentazaindene and an amino pentazaindene.

10. The element of claim 9 wherein step (a) comprises lowering the pH of the sensitized emulsion from a first pH of about 6.0 to 6.5 to a second pH of about 5.0.

11. The element of claim 9 or 10 wherein step (a) comprises increasing the Br ion/Ag ratio at least 5 mg Br/gAg.

12. The element of claim 9 wherein said stabilizer is an hydroxy tetrazaindene.

13. The element of claim 12 wherein said stabilizer is 4-hydroxy-6-methyl-1,3,3a7-tetrazaindene.

14. The element of claim 9 wherein said stabilizer is 7-benzylamino-1,3,4,6-tetrazaindene.

15. The element of claim 9 which includes an image-receiving layer.

16. The element of claim 15 wherein said silver halide emulsion has a dye image-forming material associated therein and said image-receiving layer is adapted to receive a dye image diffusing thereto after photoexposure and processing of said silver halide emulsion.

17. The element of claim 15 wherein said image-receiving layer contains silver precipitating nuclei and is adapted to receive a silver diffusion transfer image.

18. A photographic film unit which comprises, in combination:
   a photosensitive element having a diffusion transfer image-receiving element affixed at least one edge thereof, said photosensitive element comprising a support carrying:
      (a) a red-sensitive silver halide emulsion spectrally sensitized with at least one spectral sensitizing dye and having associated therewith a cyan dye developer;
      (b) a green-sensitive silver halide emulsion spectrally sensitized with at least one spectral sensitizing dye and having associated therewith a magenta dye developer;
      (c) a blue-sensitive silver halide emulsion spectrally sensitized with at least one spectral sensitizing dye and having associated therewith a yellow dye developer;
   wherein at least one of said silver halide emulsions has been stabilized by:

(a) lowering the pH of said emulsion from a first pH of said emulsion subsequent to chemical ripening in excess of about 6 to a second pH of about 5.5 to 4.0 and/or increasing the Br ion/Ag ratio to at least 5 mg Br/gAg; and (b) adding 5–80 mg/gAg to said emulsion of a stabilizer selected from the group consisting of an hydroxy triazaindene, an amino triazaindene, an hydroxy tetrazaindene, an amino tetrazaindene, an hydroxy pentazaindene and an amino pentazaindene, wherein said photosensitive element and said image-receiving layers are adapted to be superposed, the support layers of each comprising the extremities of the superposed structure.

19. The film unit of claim 18 including a rupturable container retaining an aqueous alkaline processing composition and adapted to discharge its contents intermediate said superposed photosensitive and image-receiving elements.

20. The film unit of claim 19 wherein the support layer of said image-receiving element is transparent.

21. The film unit of claim 20 in which said unit is a composite structure comprising said photosensitive element and said image-receiving element permanently affixed to the other in superposed relationship, the support layers of each of said elements being outermost.

22. The film unit of claim 18 wherein (a) comprises lowering the pH of the sensitized emulsion from a pH of about 6.0 to 6.5 to a second pH of about 5.0.

23. The film unit of claim 18 or 22 wherein said (a) comprises increasing the Br ion/Ag ratio to at least 5 mg Br/gAg.

24. The film unit of claim 18 wherein said stabilizer is a hydroxy tetrazaindene.

25. The film unit of claim 24 wherein said stabilizer is 4-hydroxy-6-methyl-1,3,3a,7-tetrazaindene.

26. A photosensitive silver halide emulsion spectrally sensitized with at least a first spectral sensitizing dye, wherein said emulsion is stabilized by:

(a) lowering the pH of said emulsion from a first pH of the emulsion subsequent to chemical ripening in excess of about 6 to a second pH of about 5.5 to 4.0 and/or increasing the Br ion/Ag ratio to at least 5 mg Br ion/gAg; and subsequent to step (a), (b) adding 5–80 mg/gAg to said emulsion of a stabilizer selected from the group consisting of an hydroxy triazaindene, an amino triazaindene, an hydroxy tetrazaindene, an amino tetrazaindene, an hydroxy pentazaindene and an amino pentazaindene.

27. The emulsion of claim 26 wherein step (a) comprises lowering the pH of the sensitized emulsion from a first pH of about 6.0 to 6.5 to a second pH of about 5.0.

28. The emulsion of claim 26 or 27 wherein step (a) comprises increasing the Br ion/Ag ratio to at least 5 mg Br/gAg.

29. The emulsion of claim 26 wherein said stabilizer is an hydroxy tetrazaindene.

30. The element of claim 29 wherein said stabilizer is 4-hydroxy-6-methyl-1,3,3a,7-tetrazaindene.

31. The element of claim 26 wherein said stabilizer is 7-benzylamino-1,3,4,6-tetrazaindene.

32. The method as defined in claim 1 wherein said stabilizer is added to said emulsion in an amount of about 20 mgs/g of silver.

33. The element of claim 9 wherein said stabilizer is added to said emulsion in an amount of about 20 mgs/g of silver.

34. The film unit of claim 18 wherein said stabilizer is added to said emulsion at a level of about 20 mgs/g of silver.

* * * * *